United States Patent [19]

Hollingsworth

[11] 4,021,795

[45] May 3, 1977

[54] SYSTEM FOR INDICATING DEPLETION OF SLIVER FROM A SLIVER CAN

[76] Inventor: Robert Q. Hollingsworth, 1400 Ranier Falls Drive, Atlanta, Ga. 30329

[22] Filed: Aug. 4, 1975

[21] Appl. No.: 601,730

[52] U.S. Cl. ..... 340/272; 339/119 R; 340/246; 340/259

[51] Int. Cl.[2] ..... G08B 21/00; H01R 13/62

[58] Field of Search ..... 340/244, 246, 272, 280, 340/259, 282; 242/54.4; 19/159 R, .25; 339/119, 91 F; 137/392; 200/52, 61.2, 61.21

[56] References Cited

UNITED STATES PATENTS

| | | | |
|---|---|---|---|
| 2,018,261 | 10/1935 | Holdsworth | 19/159 R |
| 3,434,134 | 3/1969 | Batchelor | 340/272 X |
| 3,689,909 | 9/1972 | Cotter | 200/85 R X |
| 3,704,724 | 12/1972 | Holbrook et al. | 137/392 |
| 3,751,233 | 8/1973 | Tischler | 340/272 X |
| 3,810,164 | 5/1974 | Lambert | 340/272 X |
| 3,813,664 | 5/1974 | Geyer | 340/252 R X |

*Primary Examiner*—John W. Caldwell
*Assistant Examiner*—Daniel Myer
*Attorney, Agent, or Firm*—Walter M. Rodgers; Walter A. Rodgers

[57] ABSTRACT

A system for indicating a predetermined degree of depletion of sliver from any one of a plurality of sliver cans comprising a source of energy, a plurality of individual indicating devices associated respectively with each can, a common indicating device, a plurality of sensing elements mounted respectively in each can, and circuit means connecting the source of energy, each individual indicating device, the common indicating device, and each sensing device. Each sensing device actuates the associated individual indicating device as well as the common indicating device, the common indicating device being activated independently of all other sensing devices.

3 Claims, 10 Drawing Figures

SYSTEM FOR INDICATING DEPLETION OF SLIVER FROM A SLIVER CAN

In the textile industry, sliver cans are adapted to receive the output of sliver from textile carding machines, drawing frames, and pin drafters. For further processing of fiber, sliver cans are used to transport and creel in sliver at drawing frames, pin drafters, slubbers and spinning frames. As the sliver is consumed during these operations, the entire content of a sliver can is frequently exhausted due to lack of effective monitoring by the machine operator and due to the difficulty of visually determining when a can is almost empty. Naturally this causes unnecessary delays and waste of fiber because the end of sliver usually passes completely through the machine making it necessary for the operator to stop the machine, creel in a full can of sliver and thread the end of sliver through the drafting elements of the machine.

According to this invention a system is provided for indicating a predetermined degree of depletion of sliver from any one of a plurality of sliver cans. The system comprises a source of energy, a plurality of individual indicating devices associated respectively with the cans, a common indicating device arranged to provide a system signal, a plurality of sensing elements mounted respectively in the cans and each arranged to sense a predetermined degree of depletion of sliver from the associated can, circuit means interconnecting the source of energy, the individual indicating devices and controlled by the sensing devices to indicate a predetermined degree of depletion of sliver from the associated sliver can, and circuit means controlled by each sensing device for actuating the common indicating device independently of every other sensing device.

For a more detailed description of this invention, reference may be had to the following description taken in conjunction with the accompanying drawings in which FIG. 1 depicts a sliver can together with the principal elements of this invention with a portion of the can broken away to show the sensing means of this invention;

Figure 4:
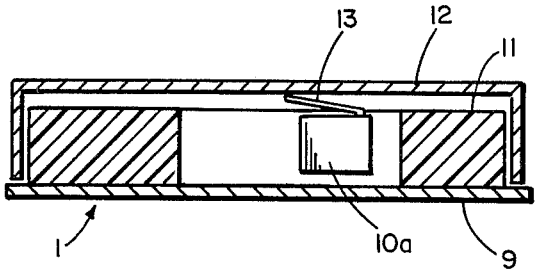
Figure 5:
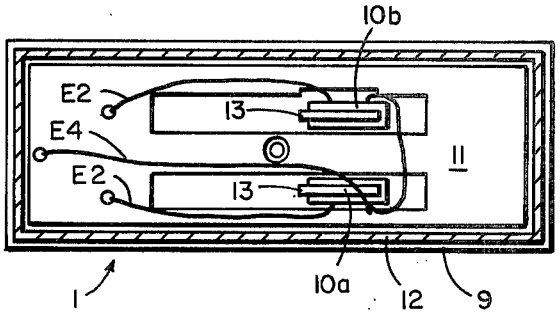
Figure 6:
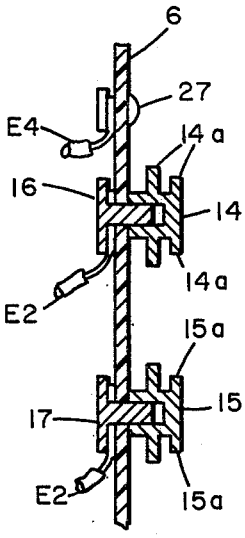
Figure 7:
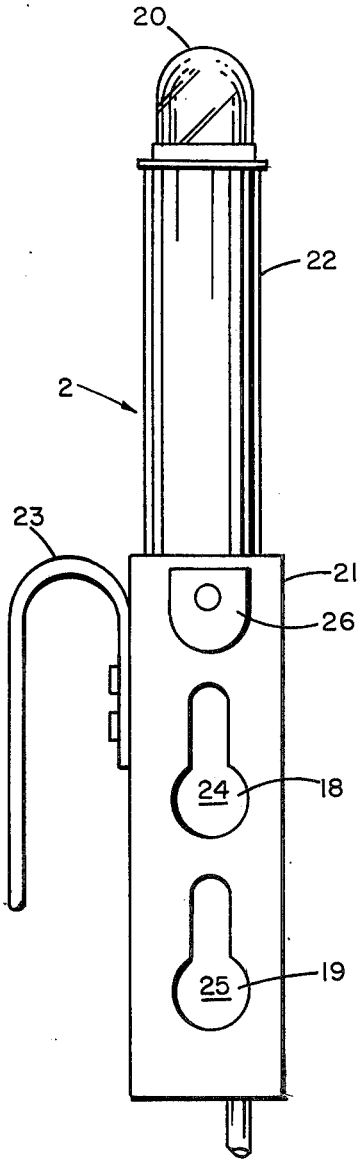
Figure 8:
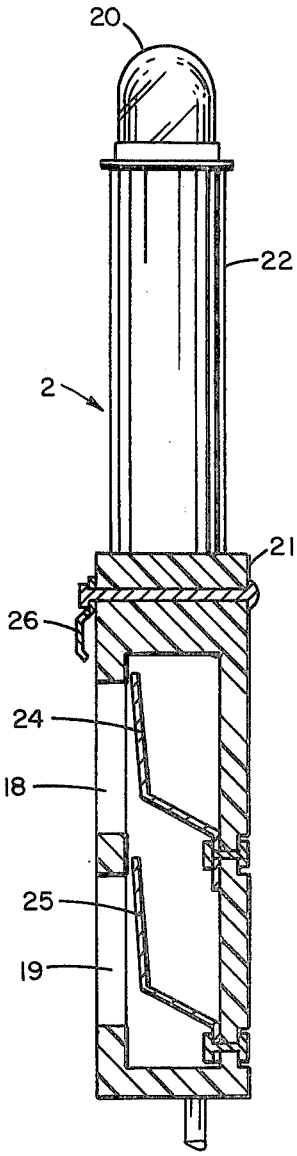
Figure 9:
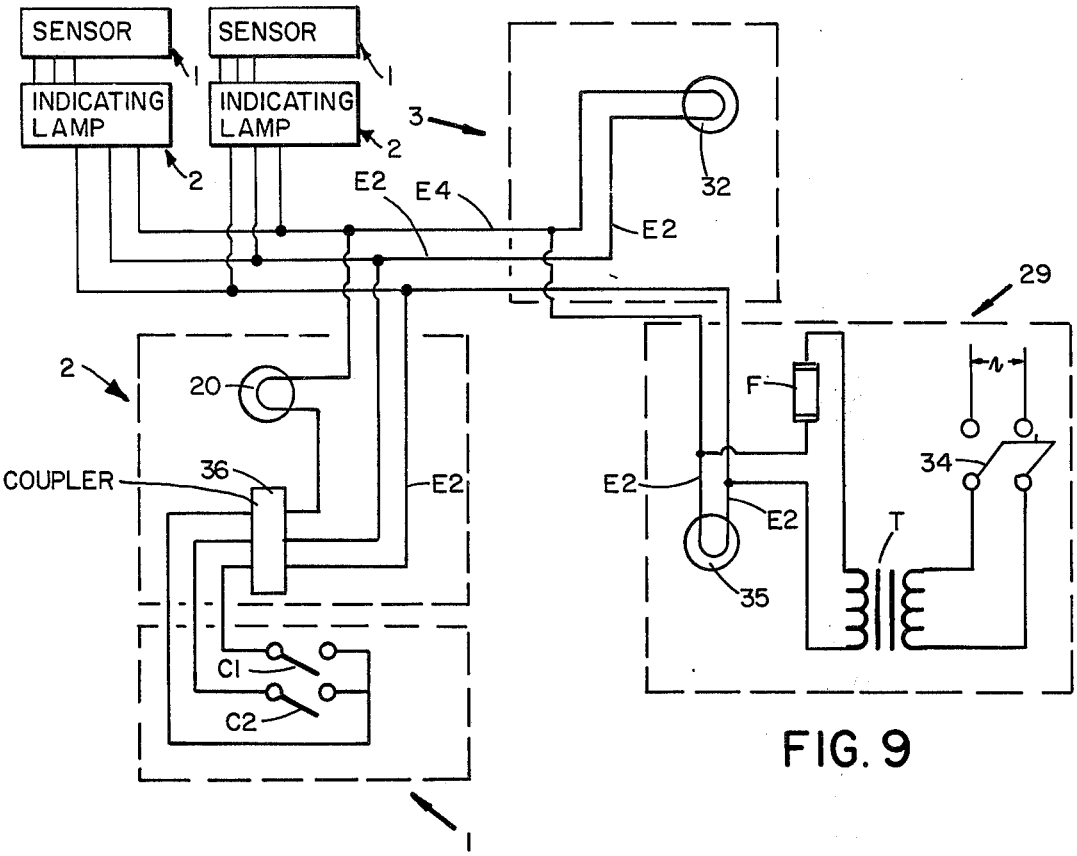
Figure 10:
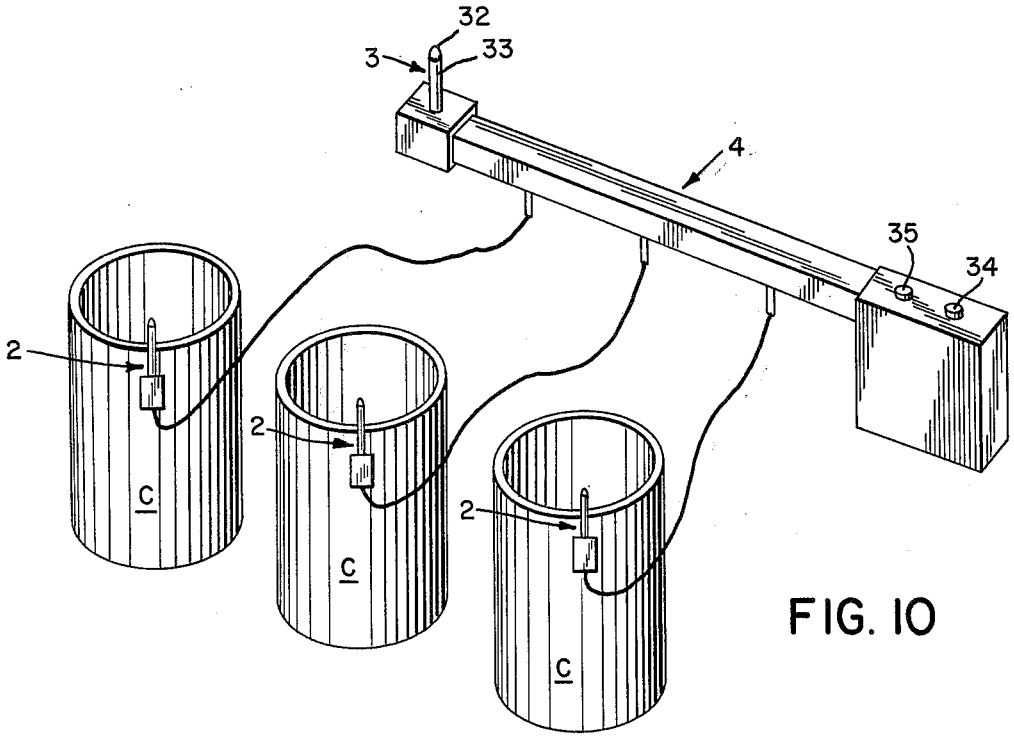

FIGS. 4 and 5 respectively are a sectional side view and a sectional bottom view of the sensing device;

FIG. 6 is a fragmentary sectional view of a wall of a sliver can showing the coupling means for use in conjunction with the individual indicating devices constructed according to this invention;

FIGS. 7 and 8 respectively are sectional front and side views of the individual indicating devices of this invention;

FIG. 9 is a schematic representation of the electric circuit for this invention; and in which FIG. 10 is a schematic system view of a plurality of sliver cans arranged according to the invention.

Figure 1:
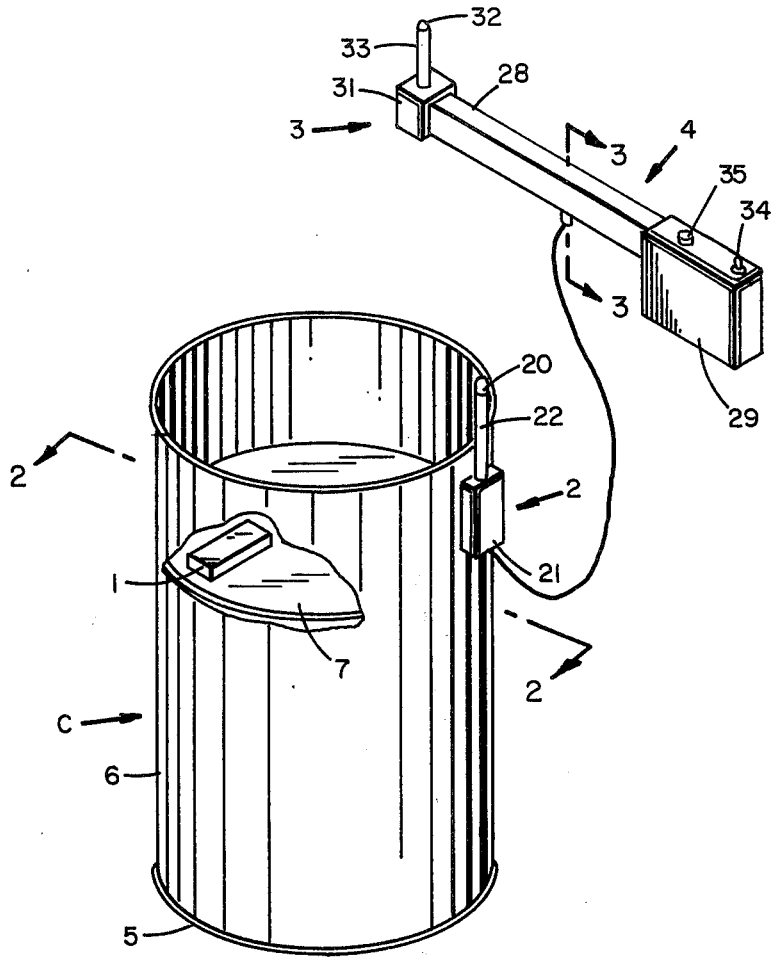

With reference to the drawings and particularly FIG. 1, the numeral 1 generally designates a sensing device constructed according to this invention. The numeral 2 generally designates the individual indicating device and the numeral 3 generally designates the common indicating device. The source of energy for this invention is generally indicated by the numeral 4.

Figure 2:
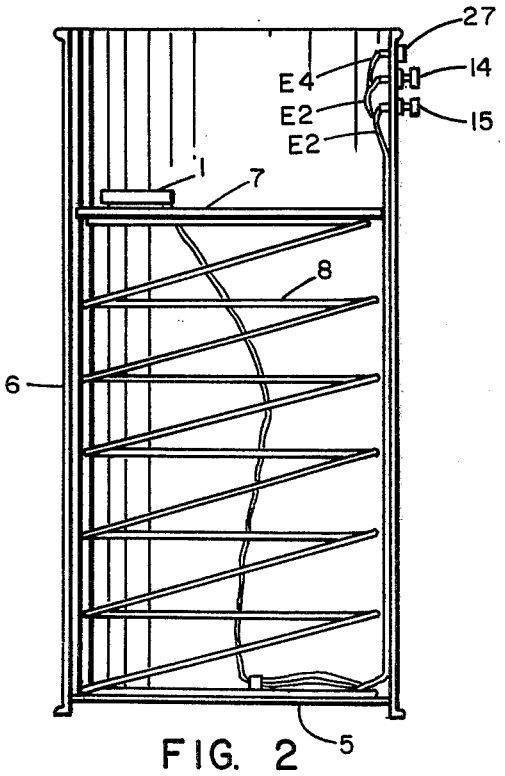
FIG. 2 is a sectional view of a sliver can taken generally along the line designated 2—2 in FIG. 1.

In FIG. 1 the letter C designates an empty sliver can having the basic elements of a bottom 5, side wall 6 and disc 7. As shown in FIG. 2 disc 7 is mounted on compression spring 8 which acts in known manner to move disc 7 in an upward direction as the amount of sliver is depleted. When the amount of sliver reaches a predetermined level during withdrawal of sliver, sensing device 1 is actuated due to reduced weight of sliver. As shown in FIGS. 4 and 5, sensing device 1 comprises a bottom 9 which is secured to supporting block 11, and which in turn is secured to microswitches 10*a* and 10*b*. Cover 12 is relatively movable in a vertical direction with respect to microswitches 10*a* and 10*b* by the action of upwardly biased leaf springs 13 which are associated with each microswitch in known manner. Only one leaf spring is observable in FIG. 4. When the amount of sliver is depleted to a predetermined amount, cover 12 moves in an upward direction under the bias of springs 13 thereby causing microswitches 10*a* and 10*b* to close.

A light responsive cell activated by ambient light entering the can may be used instead of a microswitch to activate the circuit as ambient light enters the can and reaches the cell when sliver is almost depleted. Of course the cell would be arranged so as to be uncovered prior to complete depletion of sliver as by being mounted on the disc at a level above the top surface thereof.

In order to provide a visual indication that the amount of sliver in a particular sliver can is approaching depletion, an individual indicating device 2 is provided for each can and is disjointably connected to side wall 6 of each sliver can C. More particularly conducting studs 14 and 15 are respectively mounted on side wall 6 by means of screws 16 and 17. Screws 16 and 17 provide an appropriate electrical connection for conductors E2. Each individual indicating device 2 is positioned on each side wall 6 by means of key hole apertures 18 and 19 which cooperate respectively with studs 14 and 15. Each individual indicating device 2 is held in place by the overlapping relationship respectively between shoulders 14A and 15A associated respectively with studs 14 and 15 and the upper portions of key hole apertures 18 and 19. To provide an appropriate indication of sliver depletion, light 20 is affixed on housing or disjointable support structure 21 by means of stem 22. Hanger 23 is provided for hanging the individual indicating device onto a rod not shown but which is disposed alongside bus bar 28 while cans are being changed or when a particular can is not in use. To provide the necessary electrical connection means, connector means in the form of leaf springs 24 and 25 are provided and cooperate respectively with connector means in the form of conducting studs 14 and 15 to connect the two conductors E2 with studs 14 and 15 respectively. Likewise leaf spring 26 is provided and cooperates with terminal 27 to form a connection for conductor E4.

Figure 3:
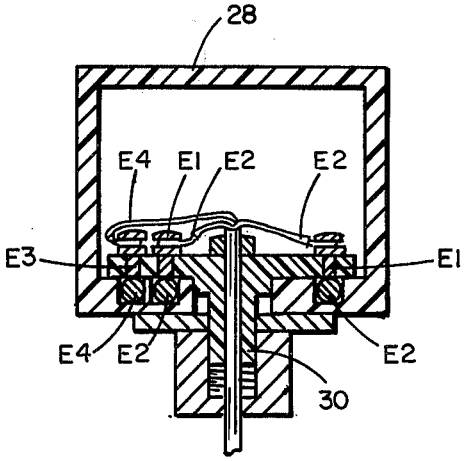
FIG. 3 is a sectional view of an electric bus which constitutes a part of the circuit means for this invention and which is taken along the line designated 3—3 in FIG. 1.

Energy for this invention is supplied by bus bar 28 from a suitable source as shown in FIGS. 1 and 3. Bus bar 28 is connected with terminal box 29 which contains a step-down transformer T, a fuse F and a circuit breaker 34.

Bus bar 28 serves to energize the indicating device on each can. In order to connect each indicating device to the conductor E2 of bus 28 each conductor E2 from each can 6 is connected with a stud E1 mounted on a terminal block 30 which in turn is disposed within the housing of bus 28 so that a connection is established between each stud E1 and each bus conductor E2.

To provide a convenient means for an operator to determine that an unidentified can is nearing depletion because a particular can has been depleted to a predetermined level, common indicating device 3 is mounted on the end of the housing of bus 28 remote from terminal box 29. Common indicating device 3 is mounted by means of block 31 and is provided with electric lamp 32 which is mounted atop block 31 by means of stem 33. Although not shown, electrical conductors are incorporated into block 31 and cooperate with conductors E4 and E2 in the housing of bus 28 to provide the necessary electrical connections therebetween. Therefore by utilizing common indicating device 3, it is not necessary for the machine operator to observe indicating devices on every sliver can at all times. Of course common indicating device 3 can be positioned in any location as required by individual situations as long as appropriate interconnection is accomplished with the other system components and need not be mounted on the housing for bus 28.

The electric cicuit for this invention is shown schematically in FIG. 9 and comprises sensing device 1, individual indicating device 2, and common indicating device 3. The system on-off switch is shown at 34 and a "system on" lamp is shown at 35. The coupling arrangement between sliver can C and individual indicating device 2 is shown schematically as coupler 36. It therefore can be seen that when sensing device 1 is actuation, individual indicating device 2 as well as common indicating device 3 are illuminated. With main switch 34 closed, transformer T and system "on" indicator lamp 35 are energized through fuse F to indicate to the operator that the system is energized. Predetermined depletion of sliver from one can results in actuation of sensor 1 associated with that can. Such action closes contacts C1 and C2 and effectively completes a circuit from bus conductors E2 through coupler 36, sensor 1 and can indicating lamp 2. Simultaneously closing of switch contacts C1 and C2 interconnects conductor E4 with conductors E2 to establish a circuit through system indicating lamp 3 and conductor E4. Thus an operator may sense system trouble generally when system lamp 3 is energized. The operator can then identify the particular can which is approaching depletion by simply observing the can indicator lamp 2. In addition it can be seen that by utilizing a three conductor system, the common indicating device operates on an independent basis in conjunction with each sensing device.

With the system of this invention, unnecessary production delays are prevented by giving an operator an advance indication as to the imminent depletion of an amount of sliver in a particular sliver can. At the same time the operator is afforded sufficient time to replace a depleted sliver can with a full can be removing the individual indicating device from the depleted can and reattracting it to the full can with very little time and effort involved.

The embodiments of the invention in which an exclusive property of privilege is claimed are defined as follows:

1. A system for indicating a predetermined degree of depletion of sliver from any one of a plurality of sliver cans, said system comprising a source of energy, a plurality of individual indicating devices disjointably mounted respectively on said cans, each indicating device comprising support structure removably mounted on a sliver can and an indicator disposed on said support structure, each of said support structures including connector means arranged to engage connector means on each can and the connector means on each can constituting mounting means for disjointably engaging said support structure and the connector means on each support structure comprising biasing means for urging the connector means on the support structure into secure engagement with the connector means on the can, a plurality of sensing elements mounted respectively in said cans and arranged to sense a predetermined degree of depletion of sliver from the associated can, circuit means interconnecting said source of energy and said individual indicating devices and said sensing devices and controlled by each sensing device respectively to indicate a predetermined degree of depletion of sliver from the associated can, and a common indicating device interconnected with said sensing devices and respectively energized thereby for providing a system signal to indicate a predetermined degree of depletion of sliver in any one of said cans.

2. A system for indicating a predetermined degree of depletion of sliver from any one of a plurality of sliver cans, each of said cans comprising a bottom, a cylindrical wall, a compression spring disposed atop said bottom, a disc disposed atop said compression spring and biased upwardly by said compression spring directly against the weight of sliver, said system comprising a source of energy, a plurality of individual indicating devices disjointably mounted respectively on said cans and each having hanger means for supporting the associated indicating means when removed from a can, a common indicating device, a plurality of sensing elements mounted respectively atop said discs and each having a cover on which sliver is disposed and being directly responsive to the weight of sliver and each having contact means biased upwardly by contact biasing means acting directly against the weight of sliver toward closed circuit position and held in open circuit position by the weight of the sliver on said cover for weight conditions exceeding said predetermined degree of depletion, circuit means interconnecting said source of energy and said individual indicating devices and said sensing devices and controlled by each sensing device respectively to cause each of said indicating devices to indicate a predetermined degree of depletion of sliver from the associated can, and circuit means controlled by each of said sensing devices and interconnected with said common indicating device to cause said common indicating device to provide a system signal in response to operation of any sensing device and independently of every other sensing device.

3. A system according to claim 1 wherein said support structure includes a housing with a plurality of keyhole apertures disposed therein and wherein said connector means on each sliver can comprises a plurality of studs each having a shoulder portion adapted respectively to cooperate with said keyhole apertures and wherein said biasing means comprises a plurality of leaf springs disposed in said housing and adapted respectively to cooperate electrically with said plurality of studs.

* * * * *